US007841500B2

(12) United States Patent
Ho

(10) Patent No.: US 7,841,500 B2
(45) Date of Patent: Nov. 30, 2010

(54) GAS CAN MOUNTING STRUCTURE FOR GAS NAIL GUN

(75) Inventor: Yu-Chuan Ho, Taichung County (TW)

(73) Assignee: Superior Power Tool Co., Ltd., Dali (TW)

( * ) Notice: Subject to any disclaimer, the term of this patent is extended or adjusted under 35 U.S.C. 154(b) by 111 days.

(21) Appl. No.: 12/314,469

(22) Filed: Dec. 11, 2008

(65) Prior Publication Data

US 2010/0096429 A1 Apr. 22, 2010

(51) Int. Cl.
*B25C 1/04* (2006.01)

(52) U.S. Cl. ..... 227/10; 227/9; 227/156; 227/130

(58) Field of Classification Search ..... 227/10, 227/9, 156, 130
See application file for complete search history.

(56) References Cited

U.S. PATENT DOCUMENTS 4,349,028 A * 9/1982 Green ..... 606/143
4,403,722 A * 9/1983 Nikolich ..... 227/8
4,483,474 A * 11/1984 Nikolich ..... 227/8
4,705,200 A * 11/1987 Kopf et al. ..... 227/9
5,364,001 A * 11/1994 Bryan ..... 227/175.1
5,636,780 A * 6/1997 Green et al. ..... 227/176.1
6,041,603 A * 3/2000 Phillips ..... 60/632
6,176,412 B1 * 1/2001 Weinger et al. ..... 227/142
6,179,192 B1 * 1/2001 Weinger et al. ..... 227/8
6,786,378 B2 * 9/2004 Wagdy et al. ..... 227/9
7,478,740 B2 * 1/2009 Shea et al. ..... 227/10
7,571,841 B2 * 8/2009 Gibson et al. ..... 227/10
2004/0211809 A1 * 10/2004 Gantner et al. ..... 227/10
2006/0060628 A1 * 3/2006 Larkin et al. ..... 227/10
2006/0102111 A1 * 5/2006 Ohmori et al. ..... 123/46 H
2007/0131731 A1 * 6/2007 Moeller et al. ..... 227/10
2008/0000451 A1 * 1/2008 Shea et al. ..... 123/46 SC
2008/0029566 A1 * 2/2008 Shkolnikov et al. ..... 227/10
2008/0110953 A1 * 5/2008 Gibson et al. ..... 227/10
2009/0090762 A1 * 4/2009 Leimbach et al. ..... 227/130
2009/0206121 A1 * 8/2009 Araiza ..... 227/10
2010/0127038 A1 * 5/2010 Ho ..... 227/156

* cited by examiner

*Primary Examiner*—Brian D Nash
(74) *Attorney, Agent, or Firm*—Bacon & Thomas, PLLC

(57) ABSTRACT

A gas can mounting structure installed in a gas nail gun having a vertically movable safety rod is disclosed to include a gas can holder for accommodating a gas can, a positioning mechanism mounted in the gas can holder and having two side plate members for guiding insertion of a gas can into the inside of the gas can holder into position, and a spring-supported roller rotatably and slidably coupled between the two side plate members for stopping against the gas can being loaded in the gas can holder to prevent gas leakage during installation of the gas can.

6 Claims, 7 Drawing Sheets

GAS CAN MOUNTING STRUCTURE FOR GAS NAIL GUN

BACKGROUND OF THE INVENTION

1. Field of the Invention

The present invention relates to a gas nail gun and more specifically, to a gas can mounting structure for gas nail gun that facilitates accurate installation of a gas can, avoiding gas leakage during the installation of the gas can.

2. Description of the Related Art

FIG. 1 shows a conventional gas nail gun 10. The gas nail gun 10 comprises a gas can holder 11 that defines therein an accommodation chamber 112 for accommodating a gas can 12, a top cover 13 pivoted to the top side of the gas can holder 11 for closing the accommodation chamber 112.

When loading a gas can 12 into the accommodation chamber 12, the gas can 12 must be turned to the right angle to let the gas valve 122 of the gas can 12 be moved along an arced face 142 of a gas nozzle 14 into an air hole 144 of the gas nozzle 14, thereby completing the loading of the gas can 12. Thereafter, as shown in FIG. 2, the top cover 13 is turned downward to close the top opening of the accommodation chamber 112, as shown in FIG. 3, and then top cover 13 is forced downwards into the locking position. When pushed the bottom end of the safety rod 15 of the gas nail gun 10, the safety rod 15 is moved upwards bias the top cover 13, forcing a roller 16 that is pivotally mounted in the top cover 13 to stop against the head 124 of the gas can 12, and therefore the gas can 12 is caused to discharge fuel gas through the gas valve 122 and the air hole 144 of the gas nozzle 14 into a combustion chamber 17, completing a gas intake stroke.

According to the aforesaid design, the gas can holder 11 has no means provided in the accommodation chamber 112 to guide insertion of the gas can 12 into the accommodation chamber 112 in the accurate direction. When inserting the gas can 12 into the accommodation chamber 112, the gas valve 122 of the gas can 12 may be not kept in accurate alignment with the arched face 142 of the gas nozzle 14 for accurate insertion into the air hole 144 of the gas nozzle 14. At this time, the user must adjust the angle of the gas can 12 to have the gas valve 112 be in accurate alignment with the arched face 142 of the gas nozzle 14, complicating the installation of the gas can 12.

Further, when the gas valve 122 of the gas can 12 is inserted into the air hole 144 of the gas nozzle 14 during installation, the gas valve 122 is kept closed. When pressing the top cover 13, as shown in FIG. 2, the pivot shaft 162 of the roller 16 will be moved upwards along a sloping surface 182 of a hook 18 at the gas can holder 11 to the top side of the sloping surface 182. When continuously pressing the top cover 13, as shown in FIG. 3, the pivot shaft 162 of the roller 16 will be moved over the top side of the sloping surface 182 and then turned downwards to the hook groove 184 of the hook 18 to lock the top cover 13. However, when the pivot shaft 162 of the roller 16 is moving over the top side of the sloping surface 182, the roller 16 imparts a push force to the head 124 of the gas can 12, forcing the gas can 12 forwards (see the imaginary line in FIG. 3), causing the gas can 12 to discharge fuel gas transiently. Therefore, a certain amount of fuel gas will leak out of the gas can during each gas can installation process.

SUMMARY OF THE INVENTION

The present invention has been accomplished under the circumstances in view. It is the main object of the present invention to provide a gas can mounting structure, which avoids gas leakage during installation of a gas can.

It is another object of the present invention to provide a gas can mounting structure, which facilitates installation of a gas can.

To achieve these and other objects of the present invention, a gas can mounting structure is installed in a gas nail gun having a vertically movable safety rod, comprising a gas can holder, a positioning mechanism and a roller supported on a spring member. The gas can holder comprises an accommodation chamber adapted to accommodate a gas can. The positioning mechanism is mounted in the accommodation chamber of the gas can holder, comprising two side plate members arranged in parallel and spaced from each other at a predetermined distance approximately equal to the outer diameter of a gas can for enabling the gas can to pass therethrough. The spring-supported roller is rotatably and slidably coupled between the two side plate members and peripherally stopped against the gas can that is inserted through the gap between the two side plate members and loaded in the accommodation chamber.

During loading of a gas can in the accommodation chamber of the gas can holder, the side plate members of the positioning mechanism constrain the gas can to be set into position accurately. After loading of the gas can in the accommodation chamber, the spring-supported roller imparts a forward pressure to the gas can, assuring accurate action of the safety rod of the gas nail gun to drive the gas can in discharging fuel gas. However, the pressure from the roller is insufficient to move the gas can out of place, avoiding gas leakage during installation of the gas can.

DETAILED DESCRIPTION OF THE INVENTION

Figure 1:
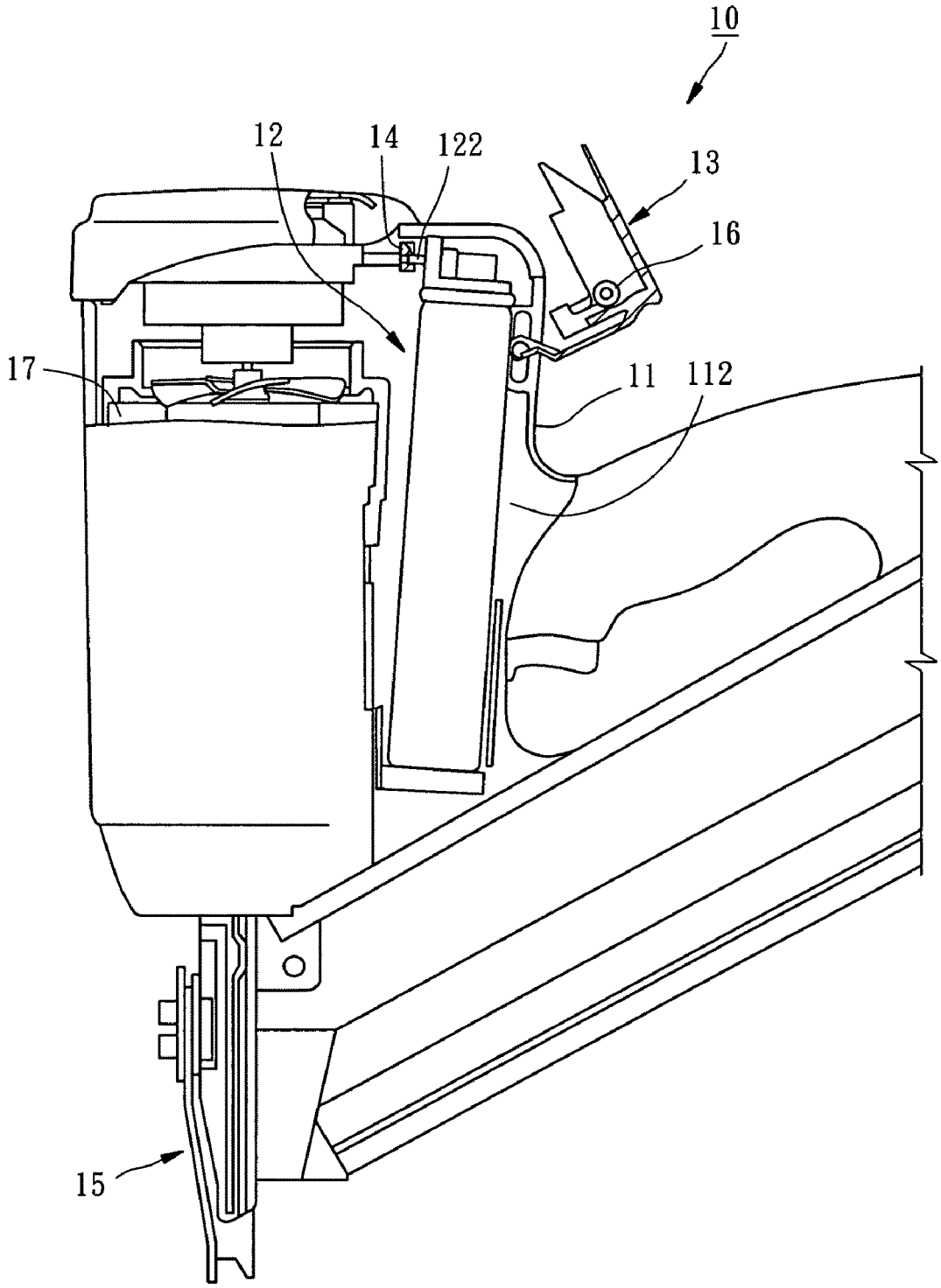
FIG. 1 PRIOR ART
FIG. 1 is a schematic drawing showing a gas can mounting structure of a gas nail gun according to the prior art.
Figure 3:
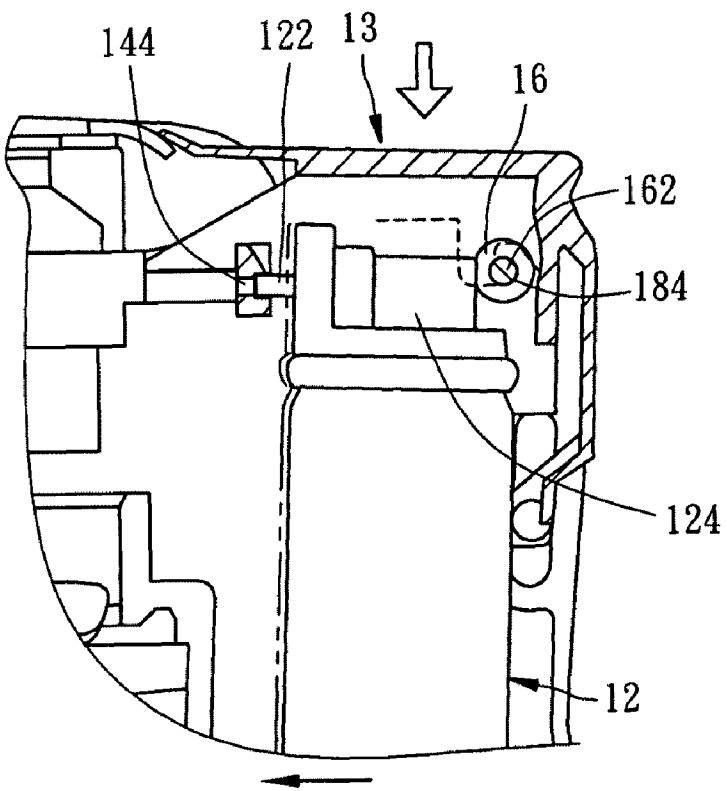
FIG. 3 PRIOR ART
FIG. 3 corresponds to FIG. 2, showing the top cover pressed down, the pivot shaft of the roller moved to the hook groove of the hook, and the gas can displaced.
Figure 2:
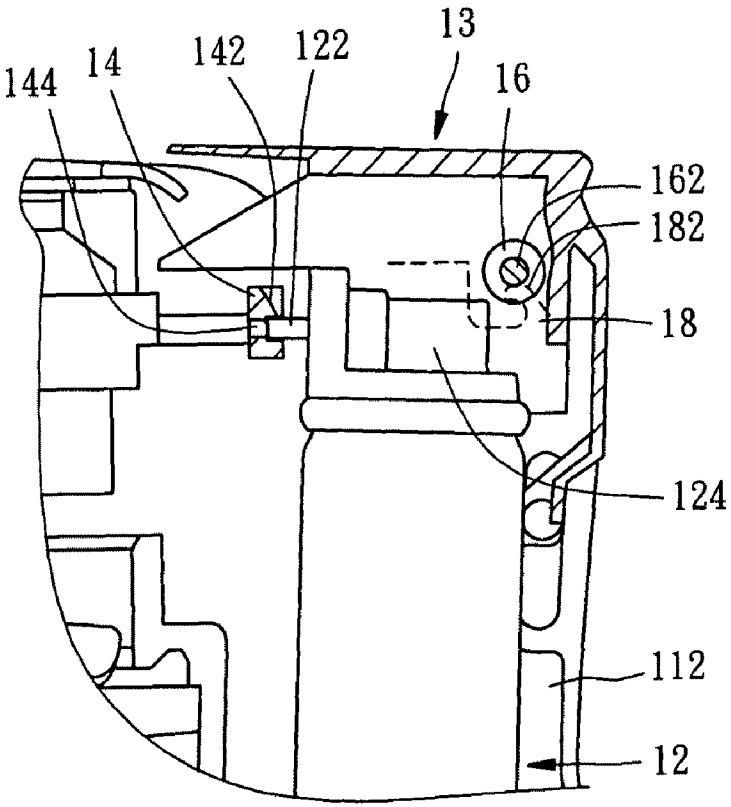
FIG. 2 PRIOR ART
FIG. 2 is an enlarged view of a part of the gas can mounting structure according to the prior art, showing the top cover biased, the pivot shaft of the roller moved to the top side of the sloping surface.
Figure 4:
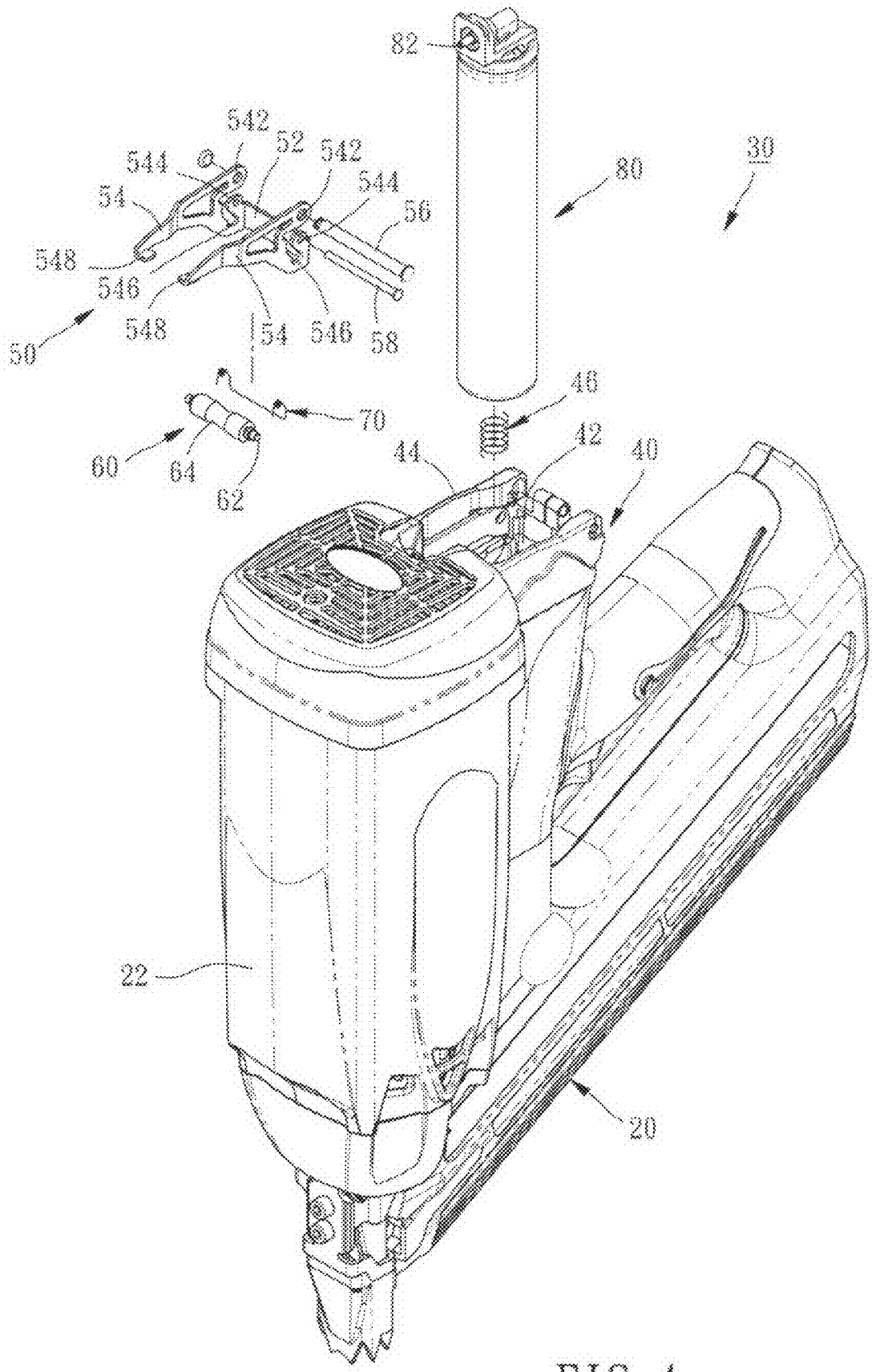
FIG. 4 is an exploded view of a gas can mounting structure in accordance with the preferred embodiment of the present invention.

Referring to FIG. 4, a gas can mounting structure 30 in accordance with the preferred embodiment of the present invention is shown comprised of a gas can holder 40, a positioning mechanism 50, a roller 60, and a coil spring 70.

Figure 6:
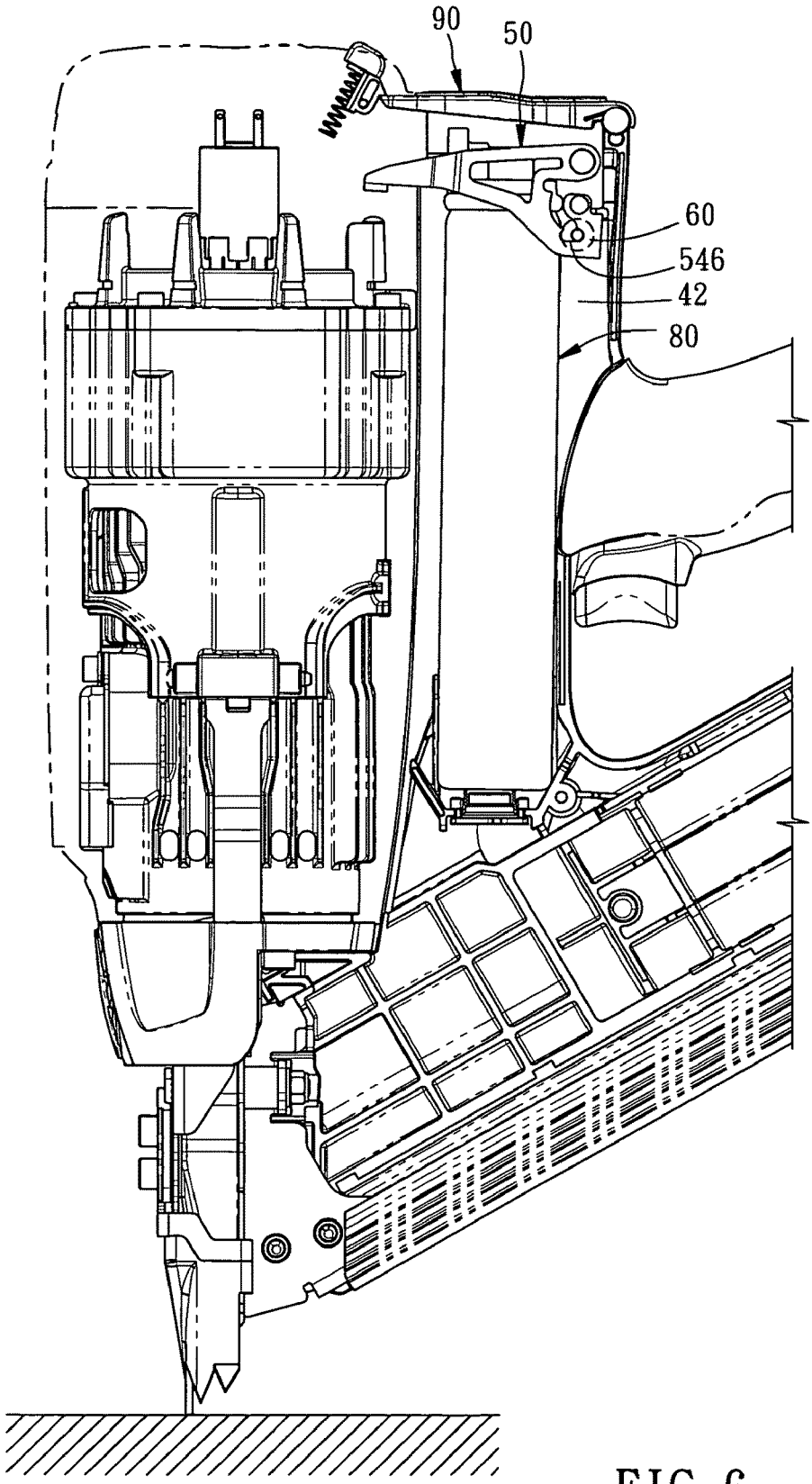
FIG. 6 is a sectional side view of the preferred embodiment of the present invention, showing the gas can installed in the accommodation chamber of the gas can holder.
Figure 8:
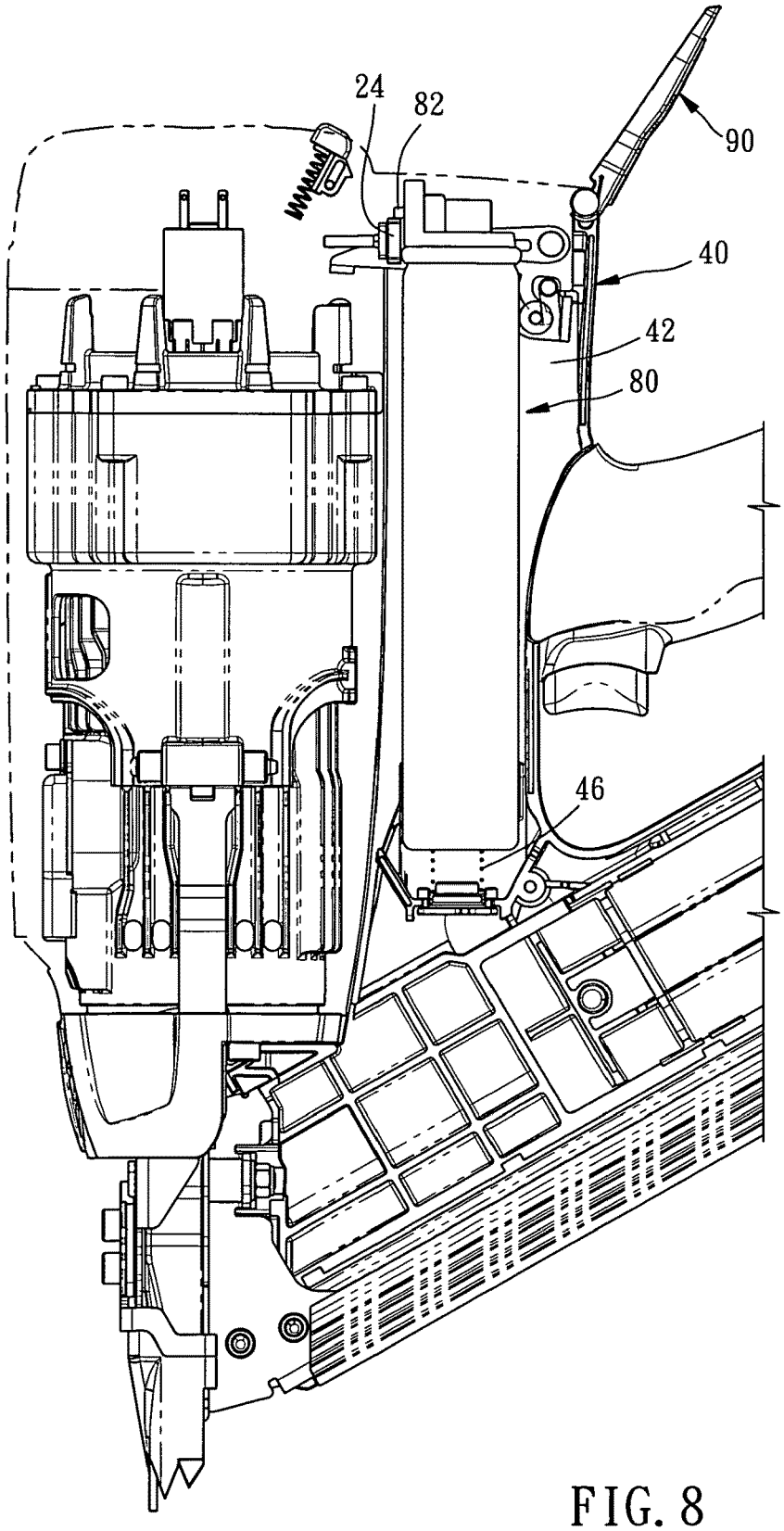
FIG. 8 is a sectional side view of the preferred embodiment of the present invention, showing spring member pushed the gas can upwards in the accommodation chamber of the gas can holder.

The gas can holder 40 is formed integral with one side of the body 22 of a gas nail gun 20, having an accommodation chamber 42 adapted to accommodate gas can 80, an opening 44 in communication between the accommodation chamber 42 and the outside space, a spring member 46 mounted in the accommodation chamber 42 at the bottom side to impart a pressure to the loaded gas can 80 toward the opening 44, as shown in FIG. 8, and a cover 90 hinged to the top side of the gas can holder 40 and adapted to close the opening 44, as shown in FIG. 6.

Figure 5:
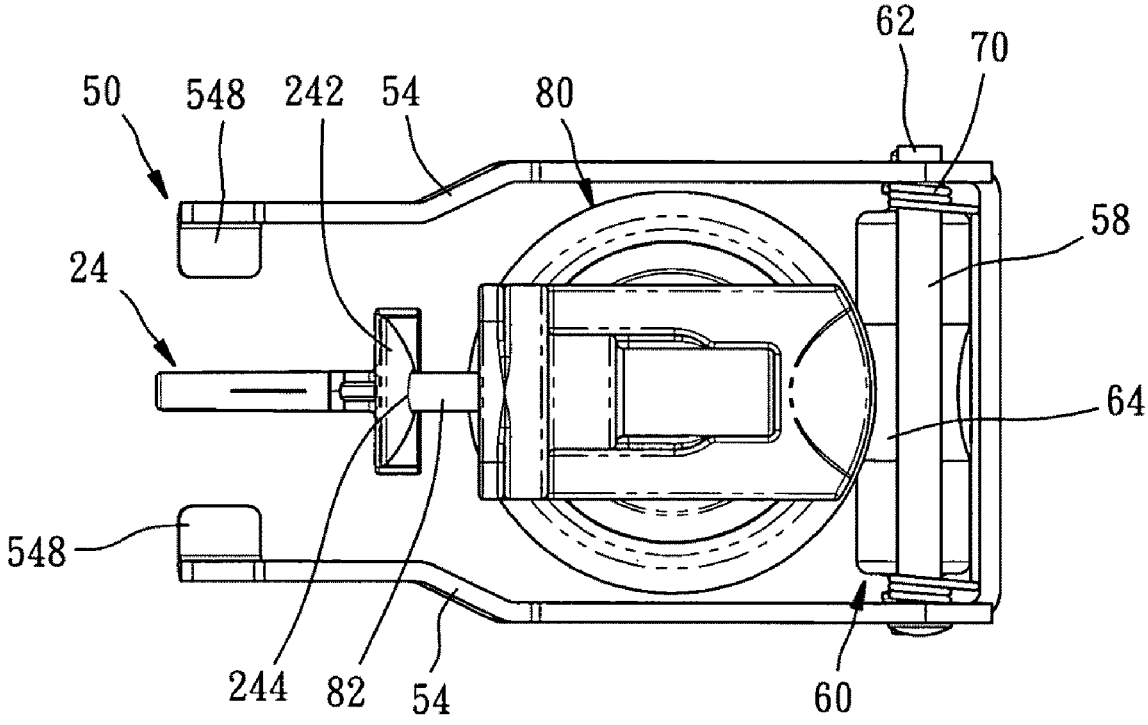
FIG. 5 is a schematic top view of the preferred embodiment of the present invention, showing the relationship between the gas can and the positioning mechanism in the accommodation chamber of the gas can holder.

The positioning mechanism 50 comprises an end plate member 52, and two side plate members 54 respectively connected to the two distal ends of the end plate member 52 in a parallel manner and spaced from each other at a distance slightly greater than the diameter of the gas can 80 so that the gas can 80 can pass through the gap between the two side plate members 54 as shown in FIG. 5. Each side plate member 54 has a pivot hole 542 at the rear side, a locating hole 544 spaced below the pivot hole 542, an elongated slot 546 spaced below the locating hole 544, and a transversely inwardly extending front lug 548 at the front side. Further, a pivot 56 is inserted through the pivot holes 542 of the side plate members 54 to pivotally connect the positioning mechanism 50 to the gas can holder 40 for enabling the positioning mechanism 50 to be received in the accommodation chamber 42. Further, a locating pin 58 is inserted through the locating holes 544 of the two side plate members 54.

The roller 60 has two pivots 62 respectively extended from its two sides and respectively coupled to the elongated slots 546 of the two side plate members 54 of the positioning mechanism 50 so that the roller 60 is movable along the elongated slots 546 between their two ends. Further, the roller 60 has a recessed middle part 64 for stopping against the periphery of the gas can 80.

The coil spring 70 is sleeved onto the locating pin 58 and pressed with its two opposite ends on the two pivots 62 of the roller 60 to impart a pressure to the roller 60, holding the roller 60 at the front ends of the elongated slots 546 of the positioning mechanism 50.

Figure 7:
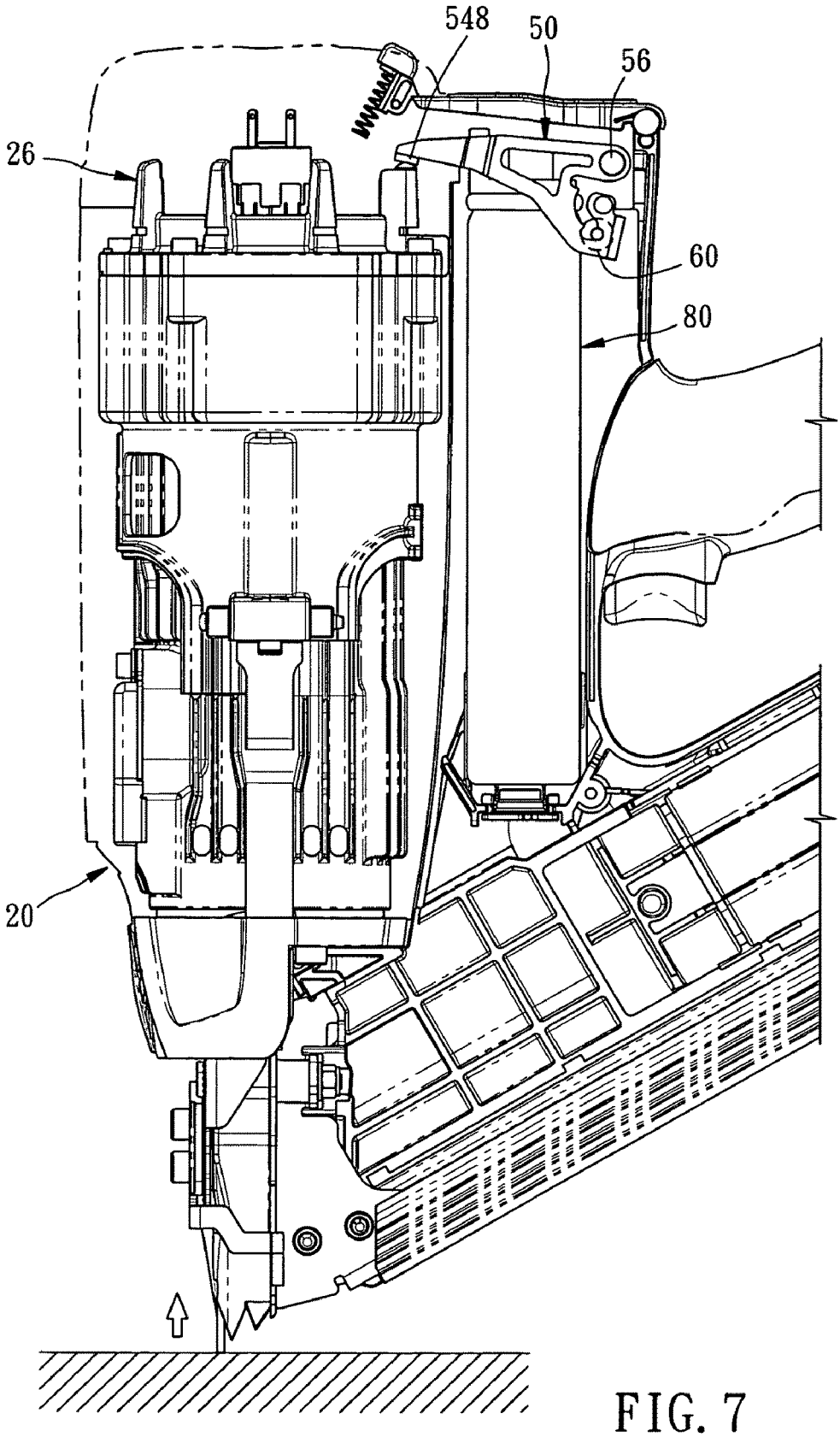
FIG. 7 corresponds to FIG. 6, showing the safety rod lifted and the positioning mechanism biased.

When in use, open the cover 90, and then insert the gas can 80 through the opening 44 of the gas can holder 40 into the inside of the accommodation chamber 42, as shown in FIGS. 5 and 6. At this time, the gas can 80 forces the roller 60 to the rear ends of the elongated slots 546 of the positioning mechanism 50. Subject to the constraint of the two side plate members 54 of the positioning mechanism 50, the gas can 80 is accurately inserted into the accommodation chamber 42 to force its gas valve 82 along the arched face 242 of the gas nozzle 24 of the gas nail gun 20 into the air hole 244 of the gas nozzle 24. At this time, the gas valve 82 of the gas can 80 is stopped. When the safety rod 26 of the gas nail gun 20 is stopped against a workpiece, as shown in FIG. 7, the safety rod 26 is forced upwards to push the front lugs 548 of the two side plate members 54 of the positioning mechanism 50, thereby turning the positioning mechanism 50 about the pivot 56. During biasing of the positioning mechanism 50, the recessed middle part 64 of the roller 60 is forced to move the gas can 80 slightly forwards, allowing fuel gas to be discharged out of the gas can 80 through the gas valve 82 and the air hole 244 of the gas nozzle 24 into the combustion chamber, completing a gas intake stroke.

As stated above, the two side plate members of the positioning mechanism and the roller hold the gas can is held in position during installation of the gas can, therefore the user simply needs to slightly adjust the position of the gas can or needs not to adjust the position of the gas can to complete the installation. Therefore, the invention facilitates loading of the gas can. Further, the coil spring imparts a pressure to the roller, forcing the recessed middle part of the roller against the periphery of the gas can, assuring accurate action of the safety rod to drive the gas can in discharging fuel gas. However, the spring force of the coil spring is insufficient to move the gas can out of place, avoiding gas leakage during installation of the gas can. Further, because the cover 90 and the positioning mechanism 50 are separately installed at different locations, the gas discharging accident during closing of the top cover of the prior art before the use will not be seen in the present invention.

Further, when wishing to take out the gas can 80, the user needs only to push the gas can 80 backwards with the fingers to disengage the gas valve 82 of the gas can 80 from the t of the air hole 244 of the gas nozzle 24. At this time, the spring member 46 immediately forces the gas can 80 upwards, as shown in FIG. 8, enabling the user to pick up the gas can 80 from the accommodation chamber 42. Therefore, the invention facilitates loading and unloading of the gas can.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A gas can mounting structure installed in a gas nail gun having a vertically movable safety rod, comprising:

a gas can holder, said gas can holder comprising an accommodation chamber adapted to accommodate a gas can;

a positioning mechanism mounted in said accommodation chamber of said gas can holder, said positioning mechanism comprising two side plate members arranged in parallel and spaced from each other at a predetermined distance approximately equal to the outer diameter of a gas can for enabling the gas can to pass therethrough; and a roller rotatably and slidably coupled between said two side plate members and peripherally stopped against the gas can that is inserted through a gap between said two side plate members and loaded in said accommodation chamber, wherein each said side plate member of said positioning mechanism comprises an elongated slot; said roller comprises two pivot rods respectively extending from two opposite sides thereof and respectively coupled to the elongated slots of said side plate members of said positioning mechanism.

2. The gas can mounting structure as claimed in claim 1, wherein said roller comprises a recessed middle part for stopping against the periphery of the gas can that is inserted through the gap between said two side plate members in said accommodation chamber.

3. A gas can mounting structure installed in a gas nail gun having a vertically movable safety rod, comprising:

a gas can holder, said gas can holder comprising an accommodation chamber adapted to accommodate a gas can;

a positioning mechanism mounted in said accommodation chamber of said gas can holder, said positioning mechanism comprising two side plate members arranged in parallel and spaced from each other at a predetermined distance approximately equal to the outer diameter of a gas can for enabling the gas can to pass therethrough;

a roller rotatably and slidably coupled between said two side plate members and peripherally stopped against the gas can that is inserted through a gap between said two side plate members and loaded in said accommodation chamber; and a coil spring mounted in said positioning mechanism and adapted to impart a pressure to said roller against the gas can that is inserted through the gap between said two side plate members in said accommodation chamber.

4. The gas can mounting structure as claimed in claim 3, wherein said roller comprises a recessed middle part for stopping against the periphery of the gas can that is inserted through the gap between said two side plate members in said accommodation chamber.

5. A gas can mounting structure installed in a gas nail gun having a vertically movable safety rod, comprising:

a gas can holder, said gas can holder comprising an accommodation chamber adapted to accommodate a gas can;

a positioning mechanism mounted in said accommodation chamber of said gas can holder, said positioning mechanism comprising two side plate members arranged in parallel and spaced from each other at a predetermined distance approximately equal to the outer diameter of a gas can for enabling the gas can to pass therethrough;

a roller rotatably and slidably coupled between said two side plate members and peripherally stopped against the gas can that is inserted through a gap between said two side plate members and loaded in said accommodation chamber; and spring means mounted in said accommodation chamber of said gas can holder and adapted to support the gas can that is loaded in said accommodation chamber and to impart an upward pressure to the gas can.

6. The gas can mounting structure as claimed in claim 5, wherein said roller comprises a recessed middle part for stopping against the periphery of the gas can that is inserted through the gap between said two side plate members in said accommodation chamber.

* * * * *